United States Patent [19]

Page et al.

[11] 3,966,466

[45] June 29, 1976

[54] PHOTOELECTROPHORETIC IMAGING PROCESS USING DARK CHARGE INJECTING AGENT ON BLOCKING ELECTRODE

[75] Inventors: Geoffrey A. Page, Rochester; Steven J. Grammatica, Webster; Joan R. Ewing, Pittsford, all of N.Y.

[73] Assignee: Xerox Corporation, Stamford, Conn.

[22] Filed: Dec. 17, 1974

[21] Appl. No.: 533,552

[52] U.S. Cl. ..... 96/1.2; 96/1.3; 96/1 PE

[51] Int. Cl.[2] ..... G03G 5/12; G03G 13/01; G03G 13/24

[58] Field of Search ..... 96/1.3, 1 PE, 1 R, 1.2

[56] References Cited

UNITED STATES PATENTS

| | | | |
|---|---|---|---|
| 3,535,221 | 10/1970 | Tulagin | 96/1 PE |
| 3,595,771 | 7/1971 | Weigl | 96/1.2 |
| 3,647,660 | 3/1972 | Wells | 96/1.3 |
| 3,784,294 | 1/1974 | Wells | 96/1 PE |
| 3,804,620 | 4/1974 | Wells | 96/1 PE X |
| 3,811,883 | 5/1974 | Zographos et al. | 96/1.3 X |
| 3,870,517 | 3/1975 | Ota et al. | 96/1.5 |

*Primary Examiner*—Edward C. Kimlin

*Attorney, Agent, or Firm*—James J. Ralabate; Michael H. Shanahan; Raymond C. Loyer

[57] ABSTRACT

An improved photoelectrophoretic imaging method is disclosed wherein a blocking layer is provided with a coating which interacts, in the dark, with the pigment particles of the imaging suspension so as to provide a uniformly charged imaging suspension upon exposure of the suspension to an electric field. The coating comprises a compound selected from the group consisting of inorganic salts of lithium, iodine, tin and iron.

18 Claims, 4 Drawing Figures

PHOTOELECTROPHORETIC IMAGING PROCESS USING DARK CHARGE INJECTING AGENT ON BLOCKING ELECTRODE

BACKGROUND OF THE INVENTION

This invention relates to the photoelectrophoretic imaging process and more particularly to an improved process wherein the imaging suspension is uniformly charged.

A detailed description of the photoelectrophoretic imaging process and materials and apparatus therefor appears in U.S. Pat. Nos. 3,383,993; 3,384,488; 3,384,565 and 3,384,566. The disclosures of the aforementioned patents are hereby incorporated by reference. Briefly, the photoelectrophoretic imaging process, as described in the aforementioned incorporated patents, is a method wherein a liquid suspension of electrically photosensitive particles is placed between a pair of electrodes. The particles acquire a charge when an electrical field is placed between the electrodes which charge is modified by exposure of the particles to light thus causing a light controlled deposition of the particles on one boundary of the suspension or the other. Particle movement is caused by the force exerted on the charged particles by the electric field. The light absorbed by a particle enables it to undergo a change in polarity which then determines its position in the field. One of the electrodes in the process is termed a conductive electrode which is generally a transparent conductive material and is the electrode upon which the pigments desirably rest at the time they are exposed to appropriate electromagnetic radiation. While not subscribing to any particular theory, the aforementioned patents propose that the pigments when exposed to actinic electromagnetic radiation while resting upon the conductive electrode, acquire a charge from the electrode. Upon acquisition of such charge the particle moves toward the opposite electrode. The opposite electrode is generally covered with an electrically insulating material such that when a pigment particle contacts the electrode under influence of the field it will not give up any charge and will remain against the blocking electrode. Upon separation of the electrodes there is generally provided an optically positive image on one of the electrodes and a negative image residing on the other electrode either monochromatic or polychromatic depending upon the optical input and the colors of the pigments in the imaging suspension.

As previously mentioned, the pigments in the imaging suspension have an initial charge and also can acquire an additional electrical charge upon being subjected to an electrical field between the electrodes. One of the problems encountered in the above-mentioned process relates to the polarity of the charge acquired by the pigments of any one color. For example, while about half of certain magenta pigment particles may exhibit a negative charge in the field between the electrodes while in the dark, the other half of the pigment particles will acquire the opposite charge and thus migrate immediately, in the dark, to the blocking electrode. Thus because only some of the pigment resides on the conductive electrode, the density of the resultant image on the conductive electrode is reduced by the amount of pigment deposited on the blocking electrode. Another disadvantage of this phenomenon is the unwanted deposition on the blocking electrode of such pigments in background areas thus degrading image quality of both images produced by the process.

The problem of non-uniform charging of the pigments in the imaging suspension of the photoelectrophoretic imaging method is well known and, in fact, has been employed advantageously in the prior art. For example, a photoelectrophoretic imaging system taking advantage of the diversity of the dark charge of the pigments is disclosed in U.S. Pat. No. 3,535,221, to Tulagin. In accordance with the system disclosed therein the image sense, optical positive or optical negative is controlled such that one may produce a positive image or a negative image on either of the blocking electrode or the conductive electrode. The method of selectively producing positive or negative copies on either electrode is achieved by providing an imaging suspension with pigment particles having a sensitivity to a first range of wavelengths and providing on the blocking layer surface a photosensitive material sensitive to a second range of wavelengths. In accordance with the disclosure of that patent an optically positive image is formed on the blocking electrode by exposing the suspension and blocking layer to light in wavelengths to which only the coating on the blocking layer is sensitive. If one desires to produce an optically positive image on the conductive electrode one exposes the imaging suspension to electromagnetic radiation to which the particles of the imaging suspension are sensitive but to which the material on the blocking layer is insensitive. The positive image is formed on the blocking layer because of the diversity of charge acquired by the particles of the imaging suspension in the dark. Some of the imaging pigments are attracted to the blocking electrode to form a coating of imaging pigment particles. When the material on the blocking layer is exposed to actinic radiation the pigment particles of the suspension are repelled from the blocking layer in the exposed areas. According to the patent, the coating on the blocking layer reflects back any pigment attracted to it when the coating on the blocking layer is struck with light to which its coating is sensitive. Thus, the light exposed areas will contain no pigment while there will reside on the blocking electrode in non-light struck areas a coating of imaging pigment which has taken an opposite charge to those coating the conductive electrode. When the imaging suspension is exposed with light to which it is sensitive, but to which the coating on the blocking layer is insensitive, the imaging pigments coating the conductive layer are caused to migrate to the blocking electrode in the exposed areas. There is thus produced a positive image configuration of the imaging particles on the conductive electrode.

An even more severe problem exists with polychromatic images produced by the aforementioned process because the loss of varying amounts of pigments of the different colors in this suspension destroys the color balance intended to produce the desired final result.

There has recently been discovered a method whereby all of the pigments of the imaging suspension are uniformly charged thus overcoming the above-mentioned deficiencies. This method involves coating of the blocking layer with a material which, while in the dark and under the influence of an electrical field, injects charge into the pigments of the imaging suspension upon contact. Such materials are termed "dark charging injecting materials" as more fully described below. Such materials have previously been applied directly to the blocking electrode in particulate form.

There is disclosed, herein, a new class of dark charge injecting materials not heretofor known or appreciated as possessing the properties of dark charge injection as described above. Such materials can be employed in solid solution in a binder layer rendering the use of dark charge injection materials more efficient and convenient.

SUMMARY OF THE INVENTION

Now in accordance with the present invention, it is an object to overcome the above-noted deficiencies in the prior art photoelectrophoretic imaging process.

More specifically, it is an object of this invention to provide a photoelectrophoretic imaging process wherein all of the pigments in the imaging suspension are charged to the same polarity while in the dark and prior to imagewise exposure by means of contact with a dark charge injecting agent of increased efficiency.

Another object of this invention is to provide a dark charge injection material conveniently employed in a binder layer on the blocking layer.

Another object of this invention is to provide substantially colorless dark charge injecting agents.

Yet another object of this invention is to reduce the unwanted background material resulting from nonuniform charge acquisition of pigments in the photoelectrophoretic imaging system.

In accordance with this invention there is provided novel dark charge injecting materials heretofor unappreciated as being useful in the photoelectrophoretic imaging process in the manner now described. Such materials comprise the inorganic salts of iodine, lithium, iron and tin.

Typical examples of the above-described dark charge injecting materials are: potassium iodide, sodium iodide, lithium chloride, lithium bromide, stannous chloride, ferrous chloride, ferric chloride, stannic iodide, stannic bromide, ferrous nitrate, ferric nitrate, ferrous sulfate, ferric sulfate, ferrous bromide, ferrous chloride and ferrous iodide. The nature of the cation of the iodide salts and the anion of the remaining salts is not critical.

The dark charge injecting materials of this invention are most efficiently employed by dissolving them into a binder material and coating the solution onto the blocking layer by any known convenient coating method. Typical binders include materials such as the polyacrylates, alcohol soluble polyamides such as Elvamide 8061 commercially available from E. I. duPont de Nemours & Co., poly-n-vinylpyrrolidone such as PVP-K15 available commercially from GAF Corp., vinyl butyral polymers such as XYHL available from Union Carbide Plastics Corp., polyvinyl alcohol such as Gelvatol 40-10 commercially available from Shawinigan Products Corp., and gelatin such as Gelatin, U.S.P. Granular, commercially available from Fisher Scientific Corp.

Non-hydrophilic materials may also be employed as binders, preferably as aqueous emulsions or in latex form, such as, for example, polystyrenes, polyalkylmethacrylates, polyvinylchlorides and polyethylenes.

One of the advantages of the employment of the dark charge injecting materials of this invention is their color or rather their relative lack of color. That is, most of the materials of this invention are colorless. Being colorless they are not involved with light absorption in the visible spectrum. While termed "dark charge" injecting materials, such terminology refers to their action upon the pigments in the imaging suspension which takes place prior to the exposure of such pigments to electromagnetic radiation to which the pigments are sensitive while under an electrical field. Also, when in solid solution with a transparent binder material the solution remains transparent. Materials of this invention thus provide transparent dark charge injecting layers on the blocking layer of the photoelectrophoretic imaging process.

DETAILED DESCRIPTION OF THE INVENTION

In accordance with this invention there is provided a photoelectrophoretic imaging process wherein all of the pigments in the imaging suspension are charged, in the dark and prior to the imagewise exposure, to a common polarity by means of the charge injecting materials of this invention. These materials are brought into contact with the imaging suspension directly or preferably as described above, can be incorporated into a binder and the binder brought into contact with the imaging suspension, both embodiments being understood to be included in the term "contact" as employed in this specification and claims.

On the blocking electrode the dark charge injecting materials performs the function of charging the pigments intended for use in the imaging process to a uniform polarity. The uniform polarity to which the pigments are charged is such as to cause these pigments to deposit on the conductive electrode in the dark.

Experience with the method of this invention has shown that the preferred polarity of the charge injected into the imaging pigments by the dark charge injecting material is dependent upon the nature of the dark charge injecting material and the polarity of the blocking electrode. In most instances the materials of the invention preferably inject negative charges into the pigments of the imaging suspension thus making them more negative than previously and capable of being attracted to a positively charged injecting electrode. The dark charge injecting materials of this invention can inject positive charge into the imaging pigments by charging the blocking electrode positively. In most instances, positive charge injection is less efficient and therefore is not preferred.

In general, binder materials employed in the process of this invention will contain a small amount of water in some form, either as a hydrate or absorbed through atmospheric conditioning. The amount of water in the binder material is not critical and can vary over a wide range. However, an anhydrous condition has been found to severely curtail the effectiveness of the dark charge injection materials of this invention. Normal ambient atmospheric conditions are adequate to avoid an anhydrous condition in the binder layers of this invention. For this reason, hydrophilic binder materials are preferred.

The use of hydrophilic binder materials which are soluble in water allows one to easily disperse the dark charge injecting materials of this invention by dissolving both the binder and the material together and coating the blocking electrode from the solution. There is thus obtained a molecular dispersion of the material in the binder. In the case of hydrophobic binder materials, the dark charge injecting materials are dispersed in particulate form by means of typical prior art means such as ball milling or otherwise mixing the material and binder together. The particulate dispersion is then coated on the blocking layer.

An advantage of the process of this invention is the form in which the dark charge injecting materials of this invention are employed in the photoelectrophoretic process. As pointed out above, the previously known dark charge injecting material was employed in the form of a particulate coating over the blocking layer. In accordance with this invention the dark charge injection material is dissolved or molecularly dispersed in the binder layer. In the dissolved state the effectiveness of the material is so great that only a small amount of material need be employed. The binder layer typically contains an effective amount of dark charge injection material in the range of from greater than 0% to about 50% by weight. Higher amounts represent inefficient use of the active material. Preferably, the amount of dark charge injection material in the binder layer is in the range of from about 0.2% to about 20% by weight. Furthermore, the binder layers employing transparent binder materials remain when containing the above mentioned concentrations of dissolved material substantially transparent and allows the imagewise exposure of the imaging suspension through the blocking layer if so desired.

In some instances, particularly when employing a roller electrode, the dark charge injecting material of this invention is more conductive than is desired. Such conductivity reduces the density of the functional image produced by the process. To avoid such reduction of density, one can employ as the conductive electrode one which is covered with a thin coat of electrically insulating material. Typical insulating materials are polymers listed above as binders for the dark charge injecting material. Also, polymer films having one conductive side can be employed by situating the film so that the conductive side faces the conductive electrode and the insulating side faces the imaging suspension.

Another way to avoid the reduction of density due to relatively conductive dark charge injecting layers of this invention is to coat the blocking layer with strips or dots of the dark charge injecting material leaving small, uncoated areas of the electrically insulating blocking electrode between each strip. Stripes of from about 1/100 inch to about ⅛ inch in width with about 1/100 inch to about 1/64 inch space between the strips is suitable.

The materials useful in the process of this invention for the purpose of causing a charge to be injected into the pigments while in the dark condition depend upon the pigments employed in the imaging suspension. Dark charge injecting materials can be classified with respect to their ability to dark charge inject so as to form a Dark Charge Injection Series by an electrometer measurement further described below. In most instances, the dark charge injecting material in contact with the imaging suspension need only be higher in the series than the pigments employed in the imaging suspension.

An excess of dark charge injection into the pigments of the imaging suspension in accordance with this invention will decrease the photosensitivity of the pigments. In some cases, the decrease will be to the point of making a reasonable image exposure impractical. To regulate the amount of dark charge injection, one must regulate the amount of dark charge injecting material employed on the blocking layer and if such material is highly active, then the amount is decreased so that the dark charge injection will be adequate to provide a uniformly charged imaging suspension, but will not unduly reduce the photosensitivity of the pigments.

The iodide salts of this invention are found to have much longer active life provided the material is stored in the dark. Through experience, the active life of the iodide salts of this invention have been found to be curtailed if the coated blocking layer is exposed to light.

Any candidate material can be placed in the Dark Charge Injection Series by means of a simple test. According to the test, as is more fully described below, the candidate material is placed on an electrically insulating film and the film laid on a flat electrode. A second electrode, preferably a roller, is spaced apart from the candidate material and the space filled with an electrically insulating liquid such as is suitable for use in a photoelectrophoretic imaging suspension. The electrodes are then connected to a source of electrical potential in the range of about 800 to about 3,000 volts and the roller passed over the candidate material at a speed such that any point of the candidate material is subjected to the electrical field for about 1/10 second. After the roller has passed over the conductive electrode with the potential applied, the amount of charge residing on the candidate material residing on the blocking layer is measured by an electrometer. The amount of charge remaining on the candidate material, expressed as voltage, determines the place the candidate material occupies in the Dark Charge Injection Series. The Series is arranged in terms of such voltage, with each candidate material being placed in the Series immediately above any other material providing a lower voltage in the test and below any other material providing a higher voltage value in the test.

Although this invention has been described with respect to the photoelectrophoretic imaging process, it is equally applicable to the electrophoretic imaging process. Because the dark charge injection does not require actinic electromagnetic radiation the electrophoretic imaging process can be advantageously employed with a dark charge injecting material on the blocking layer. Thus, typical prior art electrophoretic systems incorporating the dark charge injecting materials as described herein with respect to the photoelectrophoretic imaging process is within the scope of this invention.

BRIEF DESCRIPTION OF THE DRAWINGS

The invention may be further understood upon reference to the drawings which show a schematic representation of apparatus for performing the improved photoelectrophoretic imaging process of this invention.

DETAILED DESCRIPTION OF THE DRAWINGS

Figure 1:
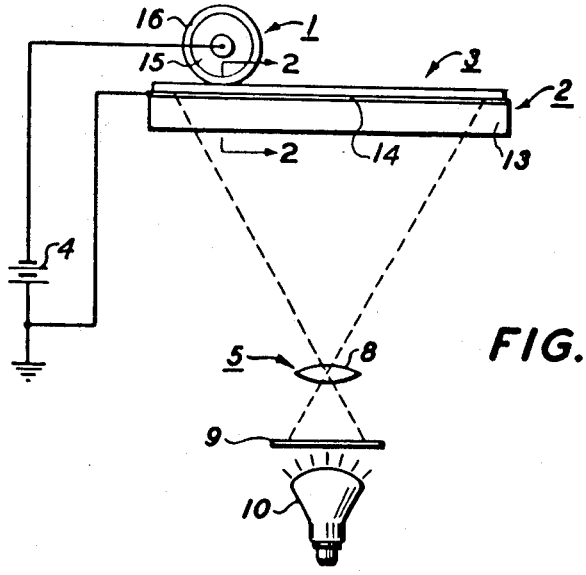
FIG. 1 is a schematic, side elevation view of a photoelectrophoretic imaging system.

FIG. 1 illustrates a conventional configuration for a photoelectrophoretic imaging system which includes the roller electrode 1, transparent conductive electrode 2 and the imaging suspension 3 containing photosensitive pigment particles. An electric field is established across the suspension in the vicinity of the electrode nip by an appropriate electrical energy source 4. The suspension is exposed by the exposure mechanism 5 to radiation to which the electrically photosensitive pigments in the imaging suspension are sensitive. Mechanism 5 includes the lens 8 which focuses a light image of the original image 9 through the transparent injecting electrode 2 onto the suspension. An appropriate light source 10 generates the electromagnetic radiation. Typically, a full frame positive image is formed on the conductive electrode 2 and a full frame optically negative image is formed on the blocking electrode, roller electrode 1. By rolling the blocking roller electrode 1 across the imaging suspension 3, the image is formed in a line by line fashion as the roller electrode rotates and translates over the transparent electrode while the light and field are applied.

Typically the transparent conductive electrode 2 includes an optically transparent glass plate 13 coated on the imaging suspension side with an optically transparent layer of conductive material such as a thin layer of tin oxide. Electrodes of this type are typically termed "injecting electrodes" because the conductive layer provides an abundant source of charge carriers for exchanging charge with exposed photosensitive pigment particles of the imaging suspension. The roller blocking electrode 1 includes a conductive core 15 overcoated with a layer 16 of electrically insulating material. Electrodes of this type are typically termed "blocking electrodes" because the insulating layer provides few if any charge carriers for exchanging charge with photosensitive pigment particles residing thereon. The insulating layer 16 may be eliminated and phototelectrophoresis will still occur but its presence insures against electrical shortage between the electrodes in addition to improving image quality. Also the transparent injecting electrode 2 may also be provided with a transparent electrically insulating layer over the tin oxide surface immediately adjacent the imaging suspension because charge carriers can be made available to the exposed electrically photosensitive pigment particles through the electrically insulating surface.

Figure 2:
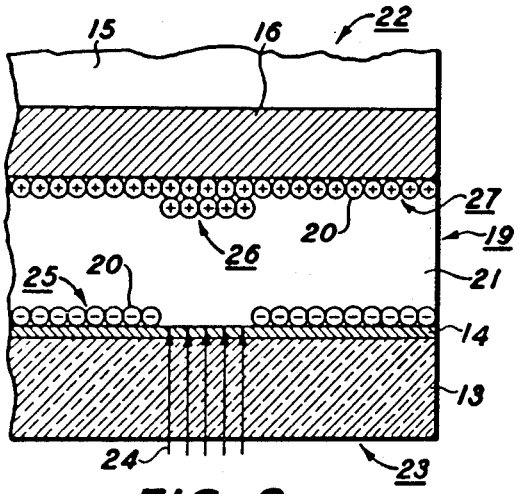
FIG. 2 is a schematic, sectional view in exaggerated proportions taken along lines 2—2 in FIG. 1 and illustrates the dark and light charged condition of prior art photoelectrophoretic systems.

FIG. 2 illustrates the light induced image forming process of an exposed imaging suspension subjected to an electric in accordance with the prior art. It should be understood that this and the other drawings are intended to convey a functional understanding of the photoelectrophoretic process and the present invention. The physical models represented in the drawings are directed to that and are not intended to be theoretical explanations of the physical and chemical mechanisms involved. The relative sizes of the electrodes, imaging suspension and pigment particles therein are not to scale but are greatly exaggerated. The above mentioned and incorporated patents may be consulted for greater detail in that regard. For example, the usual particle size in the imaging suspension is from about 0.01 to about 20 microns and the gap between the electrodes occupied by the suspension is typically in the order of about 1 mil.

Suspension 19 of FIG. 2 includes the bipolar, electrically photosensitive pigment particles 20 and an electrically insulating liquid 21. The electric field established between electrodes 22 and 23 cause the positively charged pigment particles in the imaging suspension to be attracted toward electrode 22, which in this instance is taken to be negatively charged with respect to electrode 23. The negatively charged particles are thus attracted toward positively charged electrode 23. The amount or number of pigments attracted to the electrodes vary depending upon the nature, purity and type of pigments in the imaging suspensions. Although the distribution of particles is indicated to be approximately equal, such may not be the case in most instances. However, in many imaging suspensions of the prior art there are significantly high numbers of pigment particles which have too low a charge or are of the wrong polarity and hence are either not attracted at all to the conductive electrode 23 or are attracted to the blocking layer. The number is sufficiently high so as to substantially reduce the density of the particle layer on the conductive electrode 23. Lines 24 represent electromagnetic radiation of an image directed through transparent electrode 23 to the negatively charged pigment particle layer 25. Negative particles absorbing the radiation lose their excess charge and/or negative charge carriers to become positively charged and are thus attracted in the electric field toward negative electrode 22. The migrated particles 26 comprise an optically negative image of the original and the particles remaining on electrode 23 comprise an optically positive image of the original image. It is apparent from FIG. 2 that the pigment particles forming layer 27 on the blocking electrode 22 have remained therefrom the inception of the electrical field which attracted them. They remain there completely unaffected by the imaging operation. Thus, at least two disadvantages of their presence in layer 27 are evident. First, they deprive the positive image of their contribution in terms of color balance in the polychrome system and in both monochrome and polychrome they deprive the positive image on electrode 23 of their contribution toward the density of the resulting image. Secondly, layer 27 provides unwanted background particles on the negative image residing on the blocking electrode 22. Such background is undesirable as it detracts from the qualities of the negative images thus produced.

Prior attempts at eliminating layer 27 included separating the steps of forming particle layer 25 and exposing the layer. That is, a second blocking electrode roller having a clean surface is passed over layer 25 so that particles 26 are deposited on a particle-free surface. The problem with this technique is that the particles in layer 25 are not always stable and/or bipolar particles are still present in sufficient quantities to form a particle layer similar to layer 27 on the clean roller surface. Obviously, an undesired second step is required in the prior art and the inefficient use of materials must be tolerated.

Figure 3:
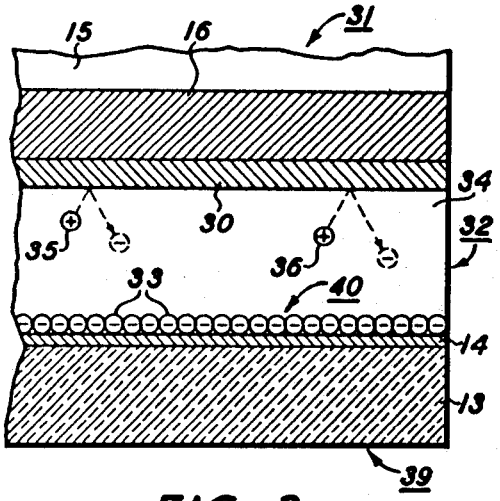
FIG. 3 is a schematic, sectional view in exaggerated proportion taken along lines 2—2 in FIG. 1 further including a dark charge injecting material on the blocking electrode in accordance with the process of this invention.

FIG. 3 illustrates a process of the present invention wherein the dark charge injecting material in binder layer 30 resides on blocking layer 16. As explained previously, the application of an electric field between electrodes 31 and 39 causes the pigment particles of an imaging suspension to be attracted toward the electrode of opposite polarity to the charge acquired by the various pigment particles. Thus, layer 40 is formed on conductive electrode 39 which is charged positively with respect to electrode 31 in the electrical field. The originally positively charged pigment particles of imaging suspension 32 are attracted toward negatively charged electrode 31. In FIG. 3 these are illustrated as particles 35 and 36 which upon coming in contact with the dark charge injecting material forming layer 30 become negatively charged and are thus attracted toward electrode 39 leaving the blocking layer free of pigment particles deposits. As mentioned above, the dark charge injecting material causes the pigment particles to acquire a charge of the same polarity as the electrode upon which the dark charge injecting material resides. The actual charge exchange mechanism is not presumed to be explained herein. Regardless of the mechanism involved, the positively charged particles become negative and join the originally negatively charged particles initially attracted to a transparent conductive electrode 39 to form layer 40. Ideally, all the particles in the suspension are attracted into and form layer 40 thereby increasing the potential maximum optical densities for the optical positive image to be formed in the photoelectrophoretic imaging process. In addition, uniform deposition of the pigment particles increases the efficiency of the materials employed in the process and the color balance of a polychrome system is more easily achieved because one need not anticipate the loss of various amounts of differently colored pigments from the final image due to the erratic nature of charge acquisition of any one colored pigment in the imaging suspension.

Layer 40 is exposed in the conventional fashion as explained above with respect to the prior art photoelectrophoretic processes. A negative image is formed by particles attracted toward electrode 31 because of the action of appropriate electromagnetic radiation to which they are exposed as shown in FIG. 2. The negative image thus produced on electrode 31 does not contain undesirable background particles and the positive image remaining on electrode 39 benefits from the increased density otherwise lost by the previously positively charged pigment particles of the imaging suspension.

Figure 4:
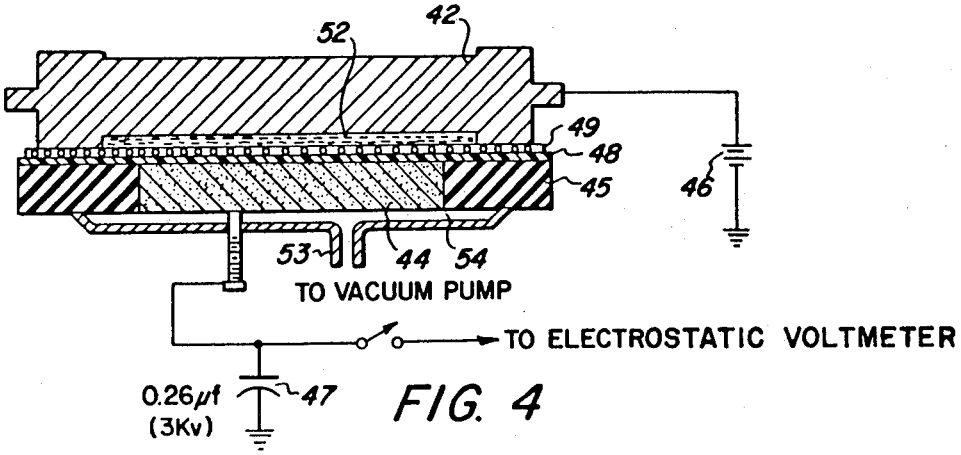
FIG. 4 is a schematic, side elevation view of a test system employed to place materials in the Dark Charge Injection Series.

As mentioned above, the materials of this invention are placed in the Dark Charge Injection Series by means of a secondary test. In FIG. 4 there appears a schematic front elevation view of one system employed to place materials in the Series. Roller electrode 42 is connected to power source 46. Electrode 44 is a porous, sintered brass plate and is connected to capacitor 47 to enable a reading of voltage by an electrostatic voltmeter (not shown).

Electrically insulating blocking layer 48 covers electrode 44 and, in turn, carries a thin layer of the candidate material 49. Layer 49 is shown in FIG. 4 in expanded form and is actually a very thin layer as described above. A suitable surface area exposed to the test is about 60 $cm^2$. Liquid layer 52 is placed between roller electrode 42 and 49. The liquid is electrically insulating and can typically be that which is useful in the photoelectrophoretic imaging process. A vacuum pump is connected to nipple 53 leading to chamber 54 for the purpose of holding layers 48 and 49 uniformly on electrode 44. With an electric field of between 1 KV to about 3 KV placed between the electrodes, roller electrode 42 passes over and in contact with liquid layer 52 while the system is in the dark so as to subject each part of the material to the field for about 0.1 second. After thus subjecting the candidate material to the electrical field, the electric charge remaining on the surface of layer 49 is measured by means such as an electrometer or electrostatic voltmeter. The amount of charge expressed in volts determines the place in the Series for the dark charge injecting material.

Any suitable material can be placed in the Series. The electrometer test described above is utilized by first coating a blocking material to a suitable thickness with a candidate material. Typical blocking layer materials are Tedlar, polyvinyl fluoride; Mylar, a polyester film both available from E. I. duPont de Nemours & Co., Inc. The coated blocking material is utilized as layers 48 and 49 in a roller configuration which can take the form of the system of FIG. 4. The insulating liquid layer 52 is free of any pigment particles and can be any liquid previously known to be useful in the prior art photoelectrophoretic imaging system. A kerosene fraction, Sohio Odorless Solvent 3440 available from the Standard Oil Co., is the preferred electrically insulating liquid. The configuration comprising the coated blocking electrode 48, the clear liquid layer 52 and conductive electrode 44 is subjected to an electrical potential of about 1,000 volts. After the roller traverse is completed, a voltage proportional to the residual charge on the blocking electrode is measured on the electrostatic voltmeter. The amount of voltage measured determines the place the candidate material occupies in the Dark Charge Injection Series. Because the materials of this invention are not sensitive in the visible spectrum, the test can be operated in normal room light.

The usefulness of any material can be easily determined by the above described secondary test which places the material in the Dark Charge Injection Series. It is simply a matter of associating the proper electrically photosensitive pigments in imaging suspension 32 with the appropriate dark charge injecting agent for use in layer 30 of FIG. 3. In accordance with the above described secondary test, a material which measures in the range of from about 1 volt to about 100 volts is normally satisfactory for use with most commonly available pigments in the imaging suspension of the photoelectrophoretic imaging process. Most dark charge injecting materials of this invention provide higher voltage readings with a negative polarity blocking electrode, and therefore, dark charge injection is best performed when the blocking electrode is made the negative electrode of the imaging system. Materials providing higher and lower readings are useful in the process of this invention when coordinated with pigments in the imaging suspension which occupy a place in the Dark Charge Injection Series lower than the material.

The dark charge injecting materials of layer 30 of FIg. 3 can be applied to the blocking layer is many ways. The material can be dispersed in a carrier liquid and painted, dipped or rolled onto the surface of a blocking electrode. Upon drying, the dark charge injecting material is fixed to the blocking electrode such that it will not disperse into the imaging suspension during the photoelectrophoretic imaging process. The liquid employed in the imaging suspension should be coordinated with the dark charge injecting material on the blocking layer such that the liquid will not dissolve or loosen the dark charge injecting material on the blocking layer.

The preferred method of applying dark charge injecting materials of this invention is to dissolve both the dark charge injecting material and a binder material in a common solvent. Layer 30 of FIG. 3 is then formed by applying the solution and allowing the solvent to evaporate leaving a coating of binder containing the dark charge injecting material.

Through experience, the dark charge injection capability of any particular material has been found to be somewhat affected by the time duration of the electric field, the concentration of the dark charge injecting material in the binder, and the magnitude of the electric field. Generally speaking, the duration of the electric field will give some increase in the amount of dark charge injection but such duration does not appear to be affected in time durations of greater than 1 second. A duration of from $10^{-6}$ seconds to $10^{-1}$ seconds tends to increase the amount of dark charge injection. In most instances, the thickness of the dark charge injecting layer on the blocking electrode is in the range of from about 0.1 to about 3 microns, although other thicknesses can be employed. In general, the amount of dark charge injection increases with increasing thickness above about 3 microns the amount of dark charge injection increase is small. While it has been found that the amount of the applied field increases the amount of dark charge injection, the amount of injection is generally sufficient for purposes of the photoelectrophoretic imaging process in the range of from about 100 to about 1,000 volts per mil although other fields can be employed. In actual practice, the operating conditions of the above described test are held constant to provide reproducible and comparable results.

DESCRIPTION OF THE PREFERRED EMBODIMENTS

The following examples further specifically define the present invention. Parts and percentages are by weight unless otherwise indicated. The examples are intended to illustrate various preferred embodiments of the process of this invention.

All of the following examples are carried out in an apparatus of the general type illustrated in FIG. 1 with the imaging suspension being coated on the conductive surface of a NESA glass electrode connected in series with a switch, a potential source and a conductive center of a blocking electrode. The roller is about 2½ inches in diameter and is moved across the plate surface at about 4 cm/second. The conductive electrode employed is roughly 3 square inches of NESA glass and is exposed with an unfiltered white light intensity of about 200 microwatts/sq. cm. as measured on the uncoated NESA glass surface. Unless otherwise indicated, about 7% by weight of the indicated pigments in each example is suspended in Sohio Odorless SOlvent 3440 to form the imaging suspension. Exposure is made with a 3200°K lamp through a transparent photographic original while a potential of 2 KV is applied between the electrodes. The dark charge injecting layer has a thickness on the blocking electrode in the range of about 0.1 to about 1 micron unless otherwise stated.

EXAMPLES I–III

Dark charge injecting materials are dispersed in various binder materials and then coated from the dispersion onto one mil thick films of polyethylene terephthalate available from the E. I. duPont Nemours Co., Inc., under the tradename Mylar. In Example I, about 5 parts of commercially available gelatine is soaked in about 95 parts of water and dissolved with gentle warming and stirring. To about 20 parts this solution is added about 0.5 parts of potassium iodide which dissolves in the solution. This solution is then coated onto the Mylar film by means of a No. 18 wire-wound drawdown rod. After evaporating the water the coated film is placed in an air-circulating oven and dried at 65°75°C C for about 30 minutes. The dried layer contains a weight ratio of 1/2 potassium iodide/binder. In Example II the above procedure is followed with the exception that about 15 parts of polyvinyl alcohol and 85 parts of water are substituted for the binder solution. The dried layer contains a weight ratio of about 1/6 potassium iodide/binder. In Example III, the procedure of Example II is followed with the exception that sodium iodide is employed in place of the potassium iodide. The dried layer contains a weight ratio of about 1/6 sodium iodide/binder.

EXAMPLE IV

About 5 parts of a nylon resin, commercially available under the tradename Elvamide 8061 are dissolved in a mixture comprising 40 parts of methanol and 40 parts of ethanol with gentle heating and stirring to form a binder solution. About 0.02 part of potassium iodide is dissolved in 20 parts of the above binder solution with heating and stirring. Upon cooling, a portion of the solution is coated onto a 1 mil thick Mylar film by means of a number 18 wire-wound drawndown rod. The coating is air dried at room temperature and then heated to a temperature in the range of from 65°C to about 75°C in an air circulating oven. The ratio of potassium iodide to nylon in the dried layer is about 1/60, respectively.

EXAMPLES V–VIII

The coated films of Examples I–IV are conditioned by allowing them to remain in normal room temperature air at 40–65% relative humidity for about 16 hours. Each film is then attached to a negatively charged roller electrode and utilized in a photoelectrophoretic imaging method employing an apparatus generally described by FIG. 1 with a positively charged NESA electrode. The imaging suspension contains equal amounts of a yellow pigment N-2''-pyridyl-8,13-dioxodinaphtho-(2,1-b;2',3'-d)-furan-6-carboxamide and cyan pigment metal-free phthalocyanine. The cyan pigment is coated with a resin by previously dissolving about 0.8 parts of purified, powdered polyethylene D/LT from Union Carbide Corp. in about 100 parts of mineral oil. About 4 parts of the cyan pigment is dispersed in the solution which is heated to 105°–110°C. The solution is cooled whereupon the polyethylene coats the pigment particles as it comes out of solution. Good color separation is achieved in each example with increased density and improved background over comparable results in the absence of the dark charge injection material.

EXAMPLE IX

The procedure of Example III and VI are repeated with the exception what 0.6 parts of ferric chloride hexahydrate is added to the 20 parts of the binder solution. The dried film contains ⅛ ratio of the ferric chloride/binder. The resulting image is noted to have improved $D_{min}$ and $D_{max}$.

EXAMPLE X

The procedure of Example IX is repeated with the exception that ferrous chloride tetrahydrate is employed in place of ferric chloride. Results similar to Example VIII are obtained.

EXAMPLE XI

The procedure of Example IX is repeated with exception that hydrated ferric citrate is employed in place of ferric chloride. The dried coating contains a ⅛ ratio of ferric nitrate/binder. Results similar to that obtained in Example IX is obtained.

EXAMPLE XI

A 20 percent solution of polyvinyl alcohol in water is prepared and to this solution lithium bromide is added in a ratio of ⅛ lithium chloride/polyvinyl alcohol. The solution is coated onto a 1 mil thick film of Tedlar. After drying as in Example I and conditioning in 65% to 80% relative humidity for 16 hours the film is attached to the negatively charged roller electrode of a device generally described in FIG. 1. The NESA electrode is also covered with a 1 mil thick film of Tedlar. An imaging suspension prepared as described in Examples IV–VI is placed on the Tedlar coated NESA. With the imaging layer being exposed to a multi-color image the roller traverses the NESA electrode, resulting in the production of an image having improved density and background.

EXAMPLE XIII

The procedure of Example XII is repeated with the exception that stannous chloride is employed in place of lithium bromide. Results similar to that obtained in Example XII is obtained.

EXAMPLE XIV

A latex is employed as a binder material which comprises 20 parts of polyethylene AC629, commercially available from Allied Chemical Co., 3.5 parts of morpholine, 3.5 parts of Acintol FA-5 also available from Allied Chemical Co., and 73 parts of water. To the latex binder there is added 100 parts of water having dissolved therein 2 parts of sodium iodide. A portion of the mixture is coated onto a 1 mil thick film of Tedlar by means of a number 17 wire-wound drawdown rod. After allowing the solvents to evaporate the coating is fused in an oven at 120°C. The dried layer has a ratio of sodium iodide to binder of about 1/10. The coated Tedlar is employed as a blocking layer in the imaging process described in Example V. Images of improved density and background are obtained.

Although specific components and proportions have been stated in the above description of preferred embodiments of the invention, other typical materials as listed above if suitable may be used with similar results. In addition, other materials may be added to the mixture to synergize, enhance or otherwise modify the properties of the imaging suspension. For example, various dyes, spectral sensitizers such as Lewis acids may be added to the suspension.

Other modifications and ramifications of the present invention will occur to those skilled in the art upon a reading of the present disclosure. These are intended to be included within the scope of this invention.

What is claimed is:

1. A photoelectrophoretic imaging process comprising the steps of providing a suspension of electrically photosensitive pigment particles in an electrically insulating carrier liquid placed between a conductive electrode and a blocking electrode, at least one of said electrodes being at least partially transparent to electromagnetic radiation to which at least a portion of said pigment particles are sensitive and said blocking electrode being coated with a dark charge injecting agent, said agent being a compound selected from the group consisting of inorganic salts of lithium, iodine, tin and iron, said dark charge injecting agent on said blocking electrode being capable of causing said pigment particles to be substantially uniformly attracted to said conductive electrode when an electrical field is applied across said suspension in the dark, subjecting said suspension to an electrical field in the dark while in contact with said dark charge injecting agent whereby said pigment particles are substantially uniformly attracted to said conductive electrode, and exposing said suspension to an imagewise pattern of electromagnetic radiation to which at least a portion of said pigment particles are sensitive until an image is formed.

2. The process of claim 1 wherein said agent resides on said blocking layer in particulate form.

3. The process of claim 1 wherein said agent is dissolved in a hydrophilic binder material.

4. The process of claim 3 wherein said agent is at a concentration of from about greater than 0% to about 50% by weight of said binder material.

5. The process of claim 3 wherein said binder and dissolved agent is substantially transparent to electromagnetic radiation to which at least a portion of said pigment particles are sensitive.

6. The process of claim 1 wherein said agent is an inorganic salt of lithium.

7. The process of claim 1 wherein said agent is an inorganic salt of iodine.

8. The process of claim 1 wherein said agent is an inorganic salt of tin.

9. The process of claim 1 wherein said agent is an inorganic salt of iron.

10. The process of claim 1 wherein said conductive electrode is coated with an electrically insulating layer.

11. A photoelectrophoretic imaging process comprising the steps of providing a suspension of electrically photosensitive pigment particles in an electrically insulating carrier liquid placed between a conductive electrode and a blocking electrode, at least one of said electrodes being at least partially transparent to electromagnetic radiation to which at least a portion of said pigment particles are sensitive and said blocking electrode being coated with a dark charge injecting agent, said agent being an alkali metal salt of iodine, said dark charge injecting agent on said blocking electrode being capable of causing said pigment particles to be substantially uniformly attracted to said conductive electrode when an electrical field is applied across said suspension in the dark, subjecting said suspension to an electrical field in the dark while in contact with said dark charge injecting agent whereby said pigment particles are substantially uniformly attracted to said conductive electrode, and exposing said suspension to an imagewise pattern of electromagnetic radiation to which at least a portion of said pigment particles are sensitive until an image is formed.

12. The process of claim 1 wherein said imaging suspension comprises pigment particles of at least two colors and having different spectrum sensitivity.

13. The process of claim 1 wherein said imaging suspension comprises particles of three different electrically photosensitive pigments each pigment being responsive to a different wavelength of electromagnetic radiation.

14. The process of claim 1 wherein the imaging suspension includes cyan colored particles which are principally photosensitive to red light, magenta colored particles which are principally photosensitive to green light and yellow colored particles which are principally photosensitive to blue light.

15. The process of claim 1 wherein said dark charge injecting agent is dispersed in particulate form in a binder material.

16. The process of claim 11 wherein said dark charge injecting agent resides in particulate form on said blocking layer.

17. The process of claim 11 wherein said agent comprises up to about 50% by weight of said binder material.

18. The process of claim 17 wherein said agent comprises up to about 50% by weight of said binder material.

* * * * *